US005254790A

United States Patent [19]

Thomas et al.

[11] Patent Number: 5,254,790

[45] Date of Patent: Oct. 19, 1993

[54] INTEGRATED PROCESS FOR PRODUCING MOTOR FUELS

[75] Inventors: Gregory D. Thomas, Martinez, Calif.; Vernon A. Cawi, Tulsa, Okla.

[73] Assignee: Phillips Petroleum Company, Bartlesville, Okla.

[21] Appl. No.: 907,500

[22] Filed: Jul. 1, 1992

[51] Int. Cl.[5] ..... C07C 2/56; C07C 5/25

[52] U.S. Cl. ..... 585/717; 585/259; 585/324; 585/331; 585/332; 585/664; 585/709; 568/697

[58] Field of Search ..... 585/259, 310, 324, 809, 585/709, 717, 332, 331, 664; 568/697

[56] References Cited

U.S. PATENT DOCUMENTS

| | | | |
|---|---|---|---|
| 4,252,541 | 2/1981 | Herbstman | 44/56 |
| 4,324,936 | 4/1982 | Mikulicz | 585/332 |
| 4,329,516 | 5/1982 | Al-Muddarris | 568/697 |
| 4,544,777 | 10/1985 | Hutson et al. | 568/697 |
| 4,558,168 | 12/1985 | Gussow et al. | 585/324 |
| 4,695,662 | 9/1987 | Vora | 585/324 |
| 4,754,078 | 6/1988 | Vora et al. | 585/331 |
| 4,761,504 | 8/1988 | Pujado | 585/331 |
| 4,774,364 | 9/1988 | Chou | 568/697 |
| 5,023,389 | 6/1991 | Grandvallet et al. | 585/315 |
| 5,100,533 | 3/1992 | Le et al. | 585/324 |
| 5,157,178 | 10/1992 | Gajda et al. | 585/259 |
| 5,160,424 | 11/1992 | Le et al. | 585/310 |

OTHER PUBLICATIONS

"Better Use of Butenes for High-Octanes Gasoline" by R. M. Heck et al., Hydrocarbon Processing, Apr. 1980, pp. 185-192.

"Now, MTBE from Butane", by G. R. Muddarris et al., Hydrocarbon Processing, Oct. 1980, pp. 91-95.

"Dehydrogenation Links LPG to More Octanes", by S. Gussow et al., Oil and Gas Journal, Dec. 8, 1980, pp. 96-101.

"Economics of Producing Intermediate Feedstocks from Butanes", by K. L. Rock et al. Energy Progress, vol. 8, No. 4, pp. 191-195, 1988.

*Primary Examiner*—Anthony McFarlane

*Attorney, Agent, or Firm*—K. K. Brandes

[57] ABSTRACT

An integrated process for converting $C_4/C_5$ hydrocarbons contained in a gasoline feedstock to more valuable motor fuel components includes various distillation steps, a hydroisomerization step, an etherification step (for producing t-amyl methyl ether), and an alkylation step. In a preferred embodiment, this process additionally includes a dehydrogenation step and a step of using formed debydrogenated hydrocarbons in the etherification step.

20 Claims, 2 Drawing Sheets

INTEGRATED PROCESS FOR PRODUCING MOTOR FUELS

BACKGROUND OF THE INVENTION

This invention relates to a process for producing motor fuels. In particular, this invention relates to the conversion of $C_4$ and $C_5$ hydrocarbons to more valuable motor fuel blending components.

Recent governmental regulations require a lowering of the vapor pressure of gasoline fuels and a reduction of air pollutants emitted from vehicles using gasoline fuels. In order to attain these environmental requirements, the content of the more volatile components, in particular $C_4$ and $C_5$ hydrocarbon, in gasoline fuels is generally lowered, and oxygenates (in particular ethers) which generate cleaner exhaust gases are generally added to gasoline fuels. The present invention attains these requirements by converting at least a portion of relatively volatile $C_4/C_5$ hydrocarbons to environmentally more acceptable gasoline components which are less volatile and have higher octane ratings, in particular t-amyl methyl ether.

SUMMARY OF THE INVENTIONS

It is an object of this invention, to provide an integrated process for converting relatively volatile $C_4/C_5$ hydrocarbons to less volatile hydrocarbons and t-amyl methyl ether. It is another object of this invention to produce motor fuel blending components from a gasoline feedstock. It is a further object of this invention to produce motor fuels having lower volatility and higher octane ratings than the gasoline feedstock from which the motor fuels are produced. Other objects and advantages will be apparent from the detailed description of the invention and the appended claims.

In accordance with this invention, a process for converting gasoline components to motor fuel components of lower volatility and higher octane rating comprises the steps of:

(1) subjecting at least one gasoline feedstock comprising (preferably consisting essentially of) hydrocarbons containing 4–12 carbon atoms per molecule to fractional distillation under such conditions as to obtain an overhead fraction comprising primarily (preferably consisting essentially of) hydrocarbons containing 4–5 carbon atoms per molecule ($C_4/C_5$ hydrocarbons) and a bottoms fraction comprising primarily (preferably consisting essentially of) hydrocarbons containing at least 6 carbon atoms per molecule (C6+ hydrocarbons);

(2) contacting the overhead fraction obtained in step (1) with added hydrogen gas and an effective hydroisomerization catalyst under such conditions as to substantially convert n-pentene-1 being present in said overhead fraction to at least one pentene containing an internal double bond (also referred to as internal amylene, in particular cis- and trans-pentene-2) and to substantially hydrogenate pentadienes present in said overhead fraction;

(3) contacting the hydroisomerate (i.e., the hydroisomerization reaction product) obtained in step (2) with added methanol and an effective etherification catalyst in an etherification reactor under such conditions as to substantially convert the added methanol and said at least one amylene contained in said hydroisomerate to tertiary-amyl methyl ether (TAME);

(4) separating the formed TAME from unconverted C4/C5 hydrocarbons contained in the etherification product obtained in step (3);

(5) subjecting the C4/C5 hydrocarbons obtained in step (4) to fractional distillation under such conditions as to obtain an overhead fraction containing primarily butenes and a bottoms fraction (called debutanized fraction) containing primarily C5 paraffins and C5 olefins;

(6) subjecting the debutanized bottoms fraction obtained in step (5) to fractional distillation under such conditions as to obtain an overhead fraction containing primarily at least one isopentane (i.e., one or two or more than two branched C5 paraffins) and a bottoms fraction containing primarily internal amylenes and n-pentene; and (7) introducing the overhead fraction from step (5), the bottoms fraction from step (6), and additional isobutane from an external source into an alkylation reactor, and contacting the thus-obtained hydrocarbon mixture with an effective alkylation catalyst under such conditions as to obtain an alkylation reaction product (alkylate) containing primarily paraffins containing at least 8 carbon atoms per molecule.

A preferred embodiment comprises the additional step of mixing the bottoms fraction (containing primarily C6+ hydrocarbons) from step (1), TAME obtained in step (4), the overhead fraction (containing primarily at least one isopentane) from step (6) and the alkylate product obtained in step (7), so as to produce a motor fuel.

Another, more preferred embodiment, comprises the additional steps of (8) contacting the overhead fraction containing primarily at least one isopentane from step (6) with an effective dehydrogenation catalyst under such conditions as to convert a major portion of said at least one isopentane to at least one isoamylene (isopentene); and (9) introducing the dehydrogenation product obtained in step (8), together with the hydroisomerate from step (2) and added methanol, into the etherification reactor of step (3) where said at least one isoamylene contained in dehydrogenation product, said at least one amylene from step (2) and added methanol are substantially converted to t-amyl methyl ether (TAME).

A further, more preferred embodiment comprises the additional step of mixing the bottoms fraction from step (1), TAME obtained in step (4) and the alkylate product obtained in step (7), so as to produce a motor fuel.

DETAILED DESCRIPTION OF THE INVENTION

Figure 1:
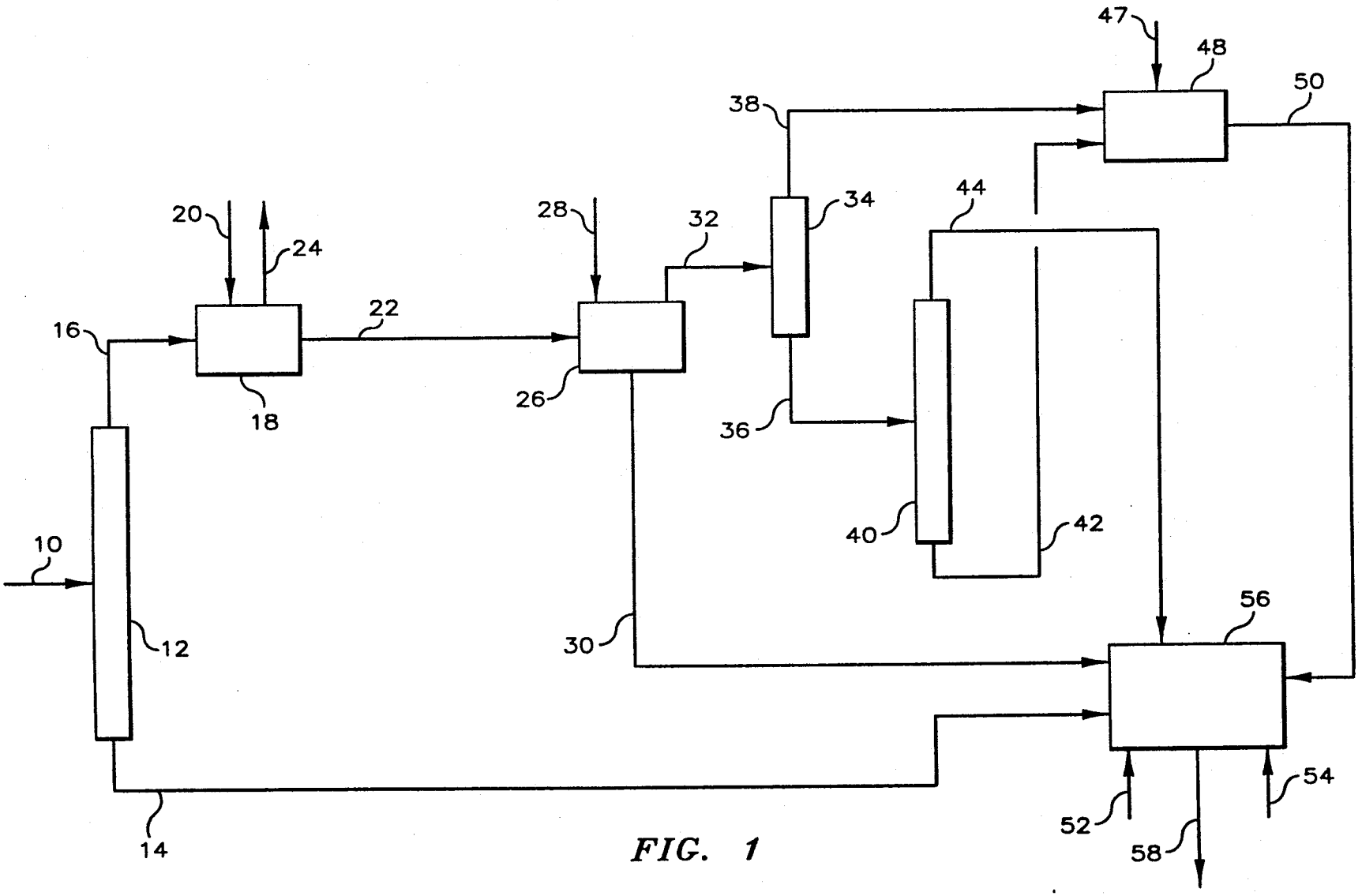
FIG. 1 illustrates a preferred embodiment of this invention comprising process steps (1) through (7).

Any suitable gasoline feedstock can be employed in the process of this invention. Generally, the feedstock is a gasoline fraction from one or more than one catalytic oil cracker or a gasoline fraction (light straight run and/or heavy straight run gasolines) from a crude distillation unit, or mixtures of these gasoline fractions. Generally, the gasoline feedstock has a boiling range (under atmospheric pressure conditions) of about 80° F. to about 400° F., and generally contains $C_4$–$C_{12}$ paraffins, $C_4$–$C_{12}$ olefins, $C_4$–$C_{12}$ cycloalkanes and $C_6$–$C_{12}$ aromatics. The composition of the gasoline feedstock varies from one feedstock to another (depending on the exact sources of the feedstocks). An example of a typical gasoline feedstock is given in Example I.

Any suitable fractional distillation column (fractionator) can be employed in step (1) of this invention. The dimensions of the fractionator and its internal makeup (i.e., use of trays or bubble caps or Raschig rings and the like), and the particular operating conditions (temperature profile within the column, feed rate reflux ratio, and the like) depend on the feedstock composition, the desired hourly throughput and economic consideration, and are easily determined by those skilled in the art. Generally, the feedstock is preheated to about 280°-300° F. before it is introduced into the fractionator, the temperature of the top of the fractionator (where the overhead fraction is withdrawn) is about 160°-170° F., and temperature at the bottom of the fractionator (where the bottoms product is withdrawn) is about 330°-350° F. Typical compositions and withdrawal rates of the overhead and bottoms fractions are presented in Table I (Example I).

The overhead fraction (containing $C_4$ and $C_5$ paraffins and olefins) is condensed and its temperature is adjusted to the desired temperature in the hydroisomerization reactor used in step (2); generally to about 100°-300° F. (preferably about 130°-200° F.). Generally, the reaction pressure in the hydroisomerization reactor is high enough to maintain the $C_4/C_5$ hydrocarbons in the liquid phase, generally at about 150-300 psig. Optimal operating conditions can be determined by those skilled in the art, since the basic principles of olefin/diolefin hydroisomerization are well known. The purpose of this process is to convert terminal olefins (in particular n-pentene-1) to internal olefins (in particular n-pentene-2) and to hydrogenate pentadienes (in particular 1,3-pentadiene) to pentanes, as is demonstrated in Table I.

The hydroisomerization process step requires relatively small amounts of added hydrogen gas (generally at a molar $H_2$/hydrocarbon ratio of about 1:1000-1:10) and an effective catalyst, generally a palladium on an inorganic carrier, preferably alumina. Generally, the catalyst contains about 0.01-2.0 weight-% Pd (preferably about 0.1-1.0 weight-% Pd), bas a surface area of about 30-150 $m^2/g$, and a total pore volume of about 0.3-0.5 cc/g. Hydroisomerization catalysts are commercially available (e.g., from Mallinckrodt, Inc., St. Louis, Mo.). Generally, the hydroisomerization process step is conducted in a fixed catalyst bed reactor at a liquid hourly space velocity (LHSV = volume of $C_4/C_5$ hydrocarbons per volume catalyst per hour) of about 2-50. Typical amounts/compositions of hydroisomerization reactants and products are presented in Table I.

In step (3), the liquid hydroisomerization product is introduced into an etherification reactor and is contacted with added methanol and an effective etherification catalyst which is generally present in a fixed catalyst bed), so as to react amylenes with methanol to tertiary-amyl methyl ether (TAME), as is demonstrated in Table I. Effective etherification catalysts are well known and are commercially available (e.g., from Dow Chemical Company, Midland, Mich. under the "Dowex" designation, or from Rohm and Haas Company, Philadelphia, Pa., under the "Amberlyst" designation). Non-limiting examples of effective catalysts include sulfonated phenol-formaldehyde resins, sulfonated polymers of coumarane-indene and cyclopentadiene, and sulfonated polystyrene resins (such as sulfonated styrene-divinylbenzene copolymer ion-exchange resins containing about 0.5-20 weight-% divinylbenzene repeat units).

Suitable etherification conditions can be selected as desired, and include a reaction temperature of about 30°-120° C., a pressure of about 30-300 psig, and a liquid hourly space velocity of the hydrocarbon stream of about 5-50 cc/cc/hour. The amount of added methanol is chosen so as to provide a molar ratio of methanol to isoamylenes of about 0.8:1 to about 1:1. It is preferred to conduct the etherification process under such conditions to assure an essentially complete conversion of added methanol to the ether product (TAME).

Separation step (4) can be carried out in any suitable manner. Generally, this separation is carried out in the exit region of the etherification reactor by adjusting temperature/pressure conditions to assure that TAME remains substantially liquid and unconverted $C_4/C_5$ hydrocarbons will exit in the vapor phase. Generally, temperature/pressure conditions of the exiting etherification reaction product (i.e., TAME and unconverted hydrocarbons) are about 140°-160° F. and about 80-100 psig.

Fractional distillation steps (5) and (6) can be carried out under any suitable effective conditions to substantially accomplish the desired separations in these steps. Dimensions, internal structures of the fractional column and specific operating conditions (temperature, pressure, reflux ratio, etc.) in both columns can easily be determined by those skilled in the art of light hydrocarbon distillation. Typical operating conditions in the "debutanizer" column of step (5) include a temperature of about 120°-130° F. at the feed entry point, a temperature of about 155-165 at the overhead exit point, a temperature of about 225-235 at the bottoms exit point, and a column pressure of about 90-100 psig. Typical operating conditions in the "$C_5$ splitter" column of step (6) include a temperature at the feed entry point of about 175°-185° F., a temperature at the overhead exit point of about 160°-170° F., a temperature at the bottoms product exit point of about 185°-195° F., and a column pressure of about 34-45 psig.

The alkylation process step (7) can be carried out in any suitable manner and in any suitable reactor since alkylation reactions for converting isoparaffins and monoolefins to higher alkanes are well known, optimal reaction conditions can be determined without undue experimentation by those skilled in the art. Typical alkylation conditions include a temperature range of about 90 to about 110° F., a pressure range of about 90 to about 120 psig, and the use of well-known alkylation catalysts such as HF, $H_2SO_4$, $AlCl_3$ and the like. The goal of the alkylation step (7) in the integrated process of this invention is to substantially convert branched butanes and branched pentanes from various sources (as illustrated in FIG. 1 and Table I) and internal amylenes (primarily contained in the bottoms fraction of the "$C_5$ splitter") to higher alkanes (in particular $C_8$-$C_{10}$ alkanes). Generally, the molar ratio of $C_4+C_5$ isoalkanes to internal amylenes is about 2:1 to about 15:1. The alkylate and products from other process steps can then be blended in any vessel at any suitable ratio so as to produce a motor fuel having a desired vapor pressure and octane number, as is demonstrated in Example I.

In a preferred embodiment, isopentane contained in the overhead fraction of the "$C_5$ splitter" of step (6) is dehydrogenated to isopentenes (isoamylenes) in step (8). Isoamylenes are then introduced as a cofeed into the etherification reactor of step (3) described above. Any suitable dehydrogenation conditions and catalysts can be employed. A preferred dehydrogenation catalyst comprises Pt, $SnO_2$, $ZnAl_2O_4$ (zinc aluminate) and, optionally, $CaAl_2O_4$ (calcium aluminate) as binder, as bas been described in U.S. Pat. No. 4,926,005. Generally, the catalyst contains about 0.05-5 weight-% Pt, about 0.1-5 weight-% Sn, about 5-25 weight-% $CaAl_2O_4$, and $ZnAl_2O_4$ as the remainder. Typical dehydrogenation reaction conditions include a reaction temperature of about 500°-650° C., a reaction pressure of about 0-200 psig, and a gas hourly space velocity of the hydrocarbon stream of about 100-10,000 cc/cc/hour. Preferably, steam is also added to the dehydrogenation reactor at a molar ratio of steam:hydrocarbon of about 0.5:1 to about 30:1. The reactor effluent is cooled so as to condense the added steam and to separate it from the other components of the dehydrogenation reaction product.

The following calculated examples are provided to further illustrate the invention and are not to be construed as being unduly limiting the scope of this invention.

EXAMPLE I

The example illustrates a preferred embodiment of this invention depicted in FIG. 1. Gasoline feedstock 10 (generally a blend of gasoline products from one or several catalytic crackers and/or a naphtha fraction from a crude oil distillation unit) is introduced into a "depentanizer" distillation column 12 where the gasoline feedstock is separated into a bottoms fraction 14 containing primarily $C_6$+ hydrocarbons and an overhead fraction 16 containing primarily $C_4/C_5$ hydrocarbons. Overhead fraction 16 and a hydrogen gas stream 20 (from an outside source) are introduced into a hydroisomerization unit 18 where terminal pentenes contained in stream 16 are converted to internal pentenes in the presence of an effective hydroisomerization catalyst (e.g., Pd on $Al_2O_3$). This reaction generated an off-gas stream 24 which contains light gases ($H_2$, $C_1$-$C_3$ hydrocarbons) and a product stream 22 (having a higher internal pentene content than stream 16) which is introduced into an etherification reactor 26 (containing a suitable etherification catalyst, preferably a sulfonated styrene-vinylbenzene copolymer resin such as "Dowex 50" or "Amberlyst 15"), together with a methanol stream 28 (from an external source). The etherification reaction yields a TAME (t-amyl methyl ether) stream 30 and a hydrocarbon stream 32 (containing unconverted $C_4/_5$ hydrocarbons), the latter being introduced into the "debutanizer" distillation column 34. The "debutanized" bottoms stream 36 contains primarily $C_5$ hydrocarbons, whereas overhead stream 38 contains primarily butenes. Bottoms stream 38 is introduced into a "$C_5$ splitter" distillation column 40 yielding a bottoms stream 42 containing primarily pentenes and an overhead stream 44 containing primarily isopentane. The overhead stream 38 from the "debutanizer", the bottoms stream 42 from the, "$C_5$ splitter", and an isobutane stream 47 from an outside source are introduced into an alkylation reactor 48 containing a suitable alkylation catalyst (e.g. , HF or $H_2SO_4$ or a Lewis acid such as $AlCl_3$-$SbF_5$). The produced alkylate stream 50 which contains primarily $C_8$+ paraffins, is generally mixed with bottoms stream 14 (containing $C_6$+ hydrocarbons), TAME stream 30, "$C_5$ splitter" overhead stream 44 (containing primarily isopentane) and, optionally, an additional isopentane stream 52 (from an outside source) and an n-butane stream 54 (from an outside source) in blending tank 56 so as to produce a high octane motor fuel product 58.

The material balance for carrying out the above-described process of FIG. 1 in a commercial-size plant is presented in Table I. All numbers associated with the components of the various process streams in Table I are given in barrel per day (BPD) units. The compositions of gas streams 20 and 24 are not included in the table and are as follows: gas stream 20 contains 255,000 standard cubic feet per day (SCFD) $H_2$, 10,000 SCFD methane and 1,000 SCFD of $C_3$ hydrocarbons; off-gas stream 24 contains 335,000 SCFD $H_2$, 26,000 SCFD methane, 10,000 SCFD $C_3$ hydrocarbons, 33,000 SCFD isobutane, 38,000 SCFD butenes and 38 SCFD n-butane.

TABLE I

| Stream No. | 10 | 14 | 16 | 22 | 28 | 30 | 32 | 36 | 38 | 42 | 44 | 47 | 50 | 52 | 54 | 58 |
|---|---|---|---|---|---|---|---|---|---|---|---|---|---|---|---|---|
| Lights[1] | 0 | 0 | 0 | 0 | 0 | 0 | 0 | 0 | 0 | 0 | 0 | 58 | 0 | 0 | 0 | 0 |
| Methanol | 0 | 0 | 0 | 0 | 428 | 0 | 0 | 0 | 0 | 0 | 0 | 0 | 0 | 0 | 0 | 0 |
| Isobutane | 15 | 0 | 15 | 15 | 0 | 0 | 15 | 0 | 15 | 0 | 0 | 3,237 | 20 | 0 | 30 | 50 |
| Butenes | 829 | 0 | 829 | 829 | 0 | 0 | 829 | 0 | 829 | 0 | 0 | 13 | 0 | 0 | 0 | 0 |
| n-Butane | 145 | 0 | 145 | 145 | 0 | 0 | 145 | 0 | 145 | 0 | 0 | 13 | 158 | 0 | 2,970 | 3,128 |
| 3-Methylbutene-1 | 138 | 0 | 138 | 138 | 0 | 0 | 14 | 1 | 12 | 0 | 1 | 0 | 0 | 0 | 0 | 1 |
| Isopentane | 4,107 | 0 | 4,107 | 4,107 | 0 | 0 | 4,107 | 3,697 | 411 | 74 | 3,623 | 0 | 485 | 8,550 | 0 | 12,657 |
| Pentene-1 | 393 | 0 | 393 | 59 | 0 | 0 | 59 | 59 | 0 | 6 | 53 | 0 | 0 | 0 | 0 | 53 |
| 2-Methylbutene-1 | 415 | 0 | 415 | 415 | 0 | 0 | 42 | 42 | 0 | 4 | 37 | 0 | 0 | 0 | 0 | 37 |
| n-Pentane | 815 | 0 | 815 | 835 | 0 | 0 | 835 | 835 | 0 | 752 | 84 | 0 | 0 | 450 | 0 | 534 |
| Pentene-2[2] | 1,292 | 0 | 1,292 | 1,626 | 0 | 0 | 1,626 | 1,626 | 0 | 1,626 | 0 | 0 | 0 | 0 | 0 | 0 |
| 2-Methylbutene-2 | 800 | 80 | 720 | 720 | 0 | 0 | 72 | 72 | 0 | 72 | 0 | 0 | 0 | 0 | 0 | 80 |
| 1,3-Pentadiene[3] | 199 | 180 | 19 | 0 | 0 | 0 | 0 | 0 | 0 | 0 | 0 | 0 | 0 | 0 | 0 | 180 |
| Misc. $C_5$'s[4] | 112 | 112 | 0 | 0 | 0 | 0 | 0 | 0 | 0 | 0 | 0 | 0 | 0 | 0 | 0 | 287 |
| $C_6$ + Hydrocarbons[5] | 36,493 | 36,493 | 0 | 0 | 0 | 0 | 0 | 0 | 0 | 0 | 0 | 0 | 13,420 | 0 | 0 | 49,913 |
| TAME | 0 | 0 | 0 | 0 | 0 | 1,426 | 0 | 0 | 0 | 0 | 0 | 0 | 0 | 0 | 0 | 1,426 |
| Sum[6] | 45,900 | 37,000 | 8,900 | 8,900 | 400 | 1,400 | 7,700 | 6,300 | 1,400 | 2,500 | 3,800 | 3,300 | 14,100 | 9,000 | 3,000 | 68,300 |

[1]mainly $C_3$ hydrocarbons
[2]cis and trans isomers
[3]trans isomers
[4]various pentanes, pentenes and pentadienes
[5]paraffins, olefins, cycloparaffins, cycloolefins and aromatic hydrocarbons containing 6 or more than 6 carbon atoms per molecule
[6]rounded off BPD numbers The Reid vapor pressure (RVP) (in psi units; measured at 100° F.) and the octane number (expressed as the average of the research octane number R and the motor octane number M) of the thus-produced motor fuel stream 58 are calculated from the corresponding data for the blending components, as is shown in Table II.

TABLE II

| Stream No. | BPD | (R + M)/2 | RVP |
|---|---|---|---|
| 14 | 37,000 | 85.9 | 1.6 |
| 30 | 1,400 | 105.5 | 1.0 |
| 44 | 3,800 | 90.6 | 20.3 |
| 50 | 14,100 | 95.0 | 5.5 |
| 52 | 9,000 | 90.0 | 20.0 |
| 54 | 3,000 | 91.6 | 52.0 |
| 58 | 68,300 | 89.2 | 6.9 |

The gasoline feedstock 10 has an octane number of 87.1 and a Reed vapor pressure of 7.2. Thus, the calculated octane number of the produced motor fuel 58 is about 2 units higher than the octane number of the gasoline feedstock 10, and the calculated Reid vapor pressure of motor fuel 58 is about 4% lower than the Reid vapor pressure of the gasoline feedstock 10. In addition, the total volume of the produced motor fuel 58 is almost 50% higher than the volume of the gasoline feedstock 10 from which it is produced.

EXAMPLE II

Figure 2:
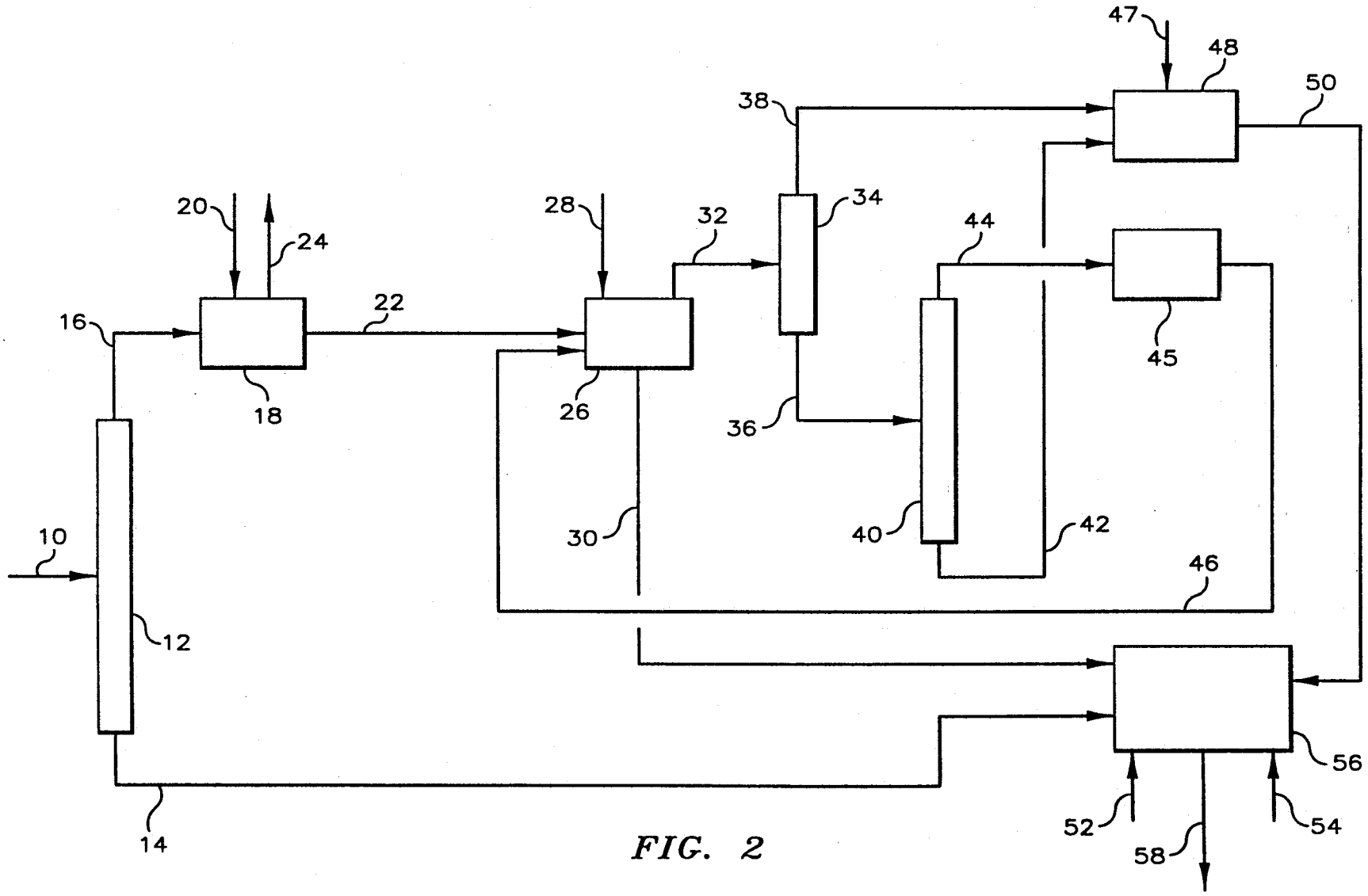
FIG. 2 illustrates another preferred embodiment of this invention comprising process steps (1) through (9).

This example illustrates another preferred embodiment of this invention depicted in FIG. 2. This integrated process of is the same as that of FIG. 1, except that "$C_5$ splitter" overhead stream 44 is not introduced into the motor fuel blending tank 56 but is used as a feed stream to a dehydrogenation reactor 45 containing a suitable dehydrogenation catalyst (preferably $Pt/SnO_2$ on $ZnAl_2O_4$, optionally with $CaAl_2O_4$ as a binder). Steam (not shown in FIG. 2) can also be added to reactor 45 (so as to minimize undesirable coke formation). The dehydrogenated effluent 46 contains primarily isopentene and is introduced into the etherification reactor 26, together with the hydroisomerizate stream 22.

The material balance for carrying out the above-described process of FIG. 2 in a commercial-size plant is presented in Table III. All numbers in Table III are BPD (barrel per day) units. The compositions of gas streams 20 and 24 are the same as presented in Example I.

R and the molar octane number M) of the motor fuel stream 58 produced by the process described in Example II and FIG. 2 are calculated from the corresponding data for the blending components, as is shown in Table IV.

TABLE IV

| Stream No. | BPD | (R + M)/2 | RVP |
|---|---|---|---|
| 14 | 37,000 | 85.9 | 1.6 |
| 30 | 5,500 | 105.5 | 1.0 |
| 50 | 14,700 | 95.0 | 5.5 |
| 52 | 9,000 | 90.0 | 20.0 |
| 54 | 4,700 | 91.6 | 52.0 |
| 58 | 70,900 | 90.2 | 6.9 |

A comparison of the data in Table IV and Table II show that the octane number of the motor fuel 58 produced by the process of this example (FIG. 2) is about 1 unit higher than the octane number of the motor fuel produced by the process of Example I (FIG. 1), whereas the Reid vapor pressures of the two motor fuels are essentially the same. A comparison of Tables II and IV also shows that about 4% more of the motor fuel is produced by the process of Example II than by the process of Example I. Thus, the integrated process described in Example II and depicted in FIG. 2 is presently considered the more preferred embodiment of this invention.

Reasonable variations and modifications which will be apparent to those skilled in the art, can be made within the scope of the disclosure and appended claims without departing from the scope of this invention.

That which is claimed is:

1. A process for converting gasoline components to motor fuel components of lower volatility and higher octane rating which comprises the steps of:

(1) subjecting at least one gasoline feedstock comprising hydrocarbons containing 4–12 carbon atoms per molecule to fractional distillation under such conditions as to obtain an overhead fraction comprising primarily hydrocarbons containing 4–5 carbon atoms per molecule and a bottoms fraction comprising primarily hydrocarbons containing at least 6 carbon atoms per molecule;

TABLE III

| Stream No. | 28 | 30 | 32 | 36 | 38 | 42 | 44 | 46 | 47 | 50 | 52 | 54 | 58 |
|---|---|---|---|---|---|---|---|---|---|---|---|---|---|
| Lights[1] | 0 | 0 | 0 | 0 | 0 | 0 | 0 | 0 | 60 | 0 | 0 | 0 | 0 |
| Methanol | 1,650 | 0 | 0 | 0 | 0 | 0 | 0 | 0 | 0 | 0 | 0 | 0 | 0 |
| Isobutane | 0 | 0 | 15 | 0 | 15 | 0 | 0 | 0 | 3,357 | 20 | 0 | 47 | 67 |
| Butenes | 0 | 0 | 829 | 0 | 829 | 0 | 0 | 0 | 13 | 0 | 0 | 0 | 0 |
| n-Butane | 0 | 0 | 145 | 0 | 145 | 0 | 0 | 0 | 13 | 159 | 0 | 4,653 | 4,812 |
| 3-Methylbutene-1 | 0 | 0 | 340 | 34 | 306 | 0 | 34 | 3,582 | 0 | 0 | 0 | 0 | 0 |
| Isopentane | 0 | 0 | 4,469 | 4,022 | 447 | 80 | 3,492 | 394 | 0 | 527 | 8,550 | 0 | 9,077 |
| Pentene-1 | 0 | 0 | 112 | 112 | 0 | 11 | 101 | 101 | 0 | 0 | 0 | 0 | 0 |
| 2-Methylbutene-1 | 0 | 0 | 46 | 46 | 0 | 5 | 41 | 41 | 0 | 0 | 0 | 0 | 0 |
| n-Pentane | 0 | 0 | 919 | 919 | 0 | 827 | 92 | 92 | 0 | 0 | 450 | 0 | 450 |
| Pentene-2[2] | 0 | 0 | 1,626 | 1,626 | 0 | 1,626 | 0 | 0 | 0 | 0 | 0 | 0 | 0 |
| 2-Methylbutene-2 | 0 | 0 | 72 | 12 | 0 | 72 | 0 | 0 | 0 | 0 | 0 | 0 | 80 |
| 1,3-Pentadiene[3] | 0 | 0 | 0 | 0 | 0 | 0 | 0 | 0 | 0 | 0 | 0 | 0 | 180 |
| Misc. $C_5$'s[4] | 0 | 0 | 0 | 0 | 0 | 0 | 0 | 0 | 0 | 0 | 0 | 0 | 287 |
| $C_6$ + Hydrocarbons[5] | 0 | 0 | 0 | 0 | 0 | 0 | 0 | 0 | 0 | 13,959 | 0 | 0 | 50,452 |
| TAME | 0 | 5,483 | 0 | 0 | 0 | 0 | 0 | 0 | 0 | 0 | 0 | 0 | 5,483 |
| Sum[6] | 1,700 | 5,500 | 8,600 | 6,800 | 1,700 | 2,600 | 4,200 | 4,200 | 3,400 | 14,700 | 9,000 | 4,700 | 70,900 |

[1]mainly $C_3$ hydro
[2]cis and trans i
[3]trans isomer
[4]various pentanes, pentenes and pentadienes
[5]paraffins, olefins, cycloparaffins, cycloolefins and aromatic hydrocarbons containing 6 or more than 6 carbon atoms per molecule.
[6]rounded off BPD numbers
Note: BPD numbers for streams 10, 14, 16 and 22 in the process of FIG. 2 are identical to those for the corresponding streams in Table I.

The Reid vapor pressure (RVP) and the octane rating (expressed as the average of the research octane number (2) contacting the overhead fraction obtained in step (1) with added hydrogen gas and an effective hydroisomerization catalyst under such conditions as to substantially convert n-pentene-1 being present in said overhead fraction to n-pentene-2 and to substantially hydrogenate 1,3-pentadiene present in said overhead fraction to n-pentane;

(3) contacting the hydroisomerate obtained in step (2) with added methanol and an effective etherification catalyst in an etherification reactor so as to substantially convert the added methanol and at least one amylene selected from the group consisting of 2-methylbutene-2 and 2-methylbutene-1 contained in said hydroisomerate to tertiary-amyl methyl ether;

(4) separating the formed tertiary-amyl methyl ether from hydrocarbons containing 4–5 carbon atoms per molecule being present in the etherification product obtained in step (3);

(5) subjecting the hydrocarbons containing 4–5 carbon atoms per molecule obtained in step (4) to fractional distillation under such conditions as to obtain an overhead fraction containing primarily butenes and a bottom fraction containing primarily C5 paraffins and C5 olefins;

(6) subjecting the debutanized bottoms fraction obtained in step (5 ) to fractional distillation under such conditions as to obtain an overhead fraction containing primarily at least one isopentane and a bottoms fraction containing primarily internal amylenes and n-pentane; and (7) introducing the overhead fraction from step (5), the bottoms fraction from step (6), and additional isobutane from an external source into an alkylation reactor, and contacting the thus-obtained hydrocarbon mixture with an effective alkylation catalyst under such conditions as to obtain an alkylation reaction product containing primarily paraffins containing at least 8 carbon atoms per molecule.

2. A process in accordance with claim 1, comprising the additional step of mixing the bottoms fraction obtained in step (1), tertiary-amyl methyl ether obtained in step (4), the overhead fraction obtained in step (6) and the alkylate product obtained in step (7), so as to produce a motor fuel.

3. A process in accordance with claim 1, wherein the hydroisomerization step (2) is carried out at a temperature of about 100°–300° F., a pressure of about 150–300 psig, and a molar hydrogen:hydrocarbon ratio of about 1:1000 to about 1:10.

4. A process in accordance with claim 3, wherein the catalyst used in said hydroisomerization step contains about 0.01–2.0 weight percent palladium and alumina as a carrier.

5. A process in accordance with claim 1, wherein the etherification step (3) is carried out at a temperature of about 30°–120° C., a pressure of about 30–300 psig and a molar ratio of methanol to said at least one amylene of about 0.8:1 to about 1:1.

6. A process in accordance with claim 5, wherein the catalyst employed in said etherification step is a sulfonated styrene-divinylbenzene copolymer ion-exchange resin containing about 0.5–20 weight-% divinylbenzene repeat units.

7. A process in accordance with claim 1, wherein alkylation step (7) is carried out at a temperature of about 90°–110° F. and a pressure of about 90–120 psig, in the presence of a catalyst selected from the group consisting of hydrogen fluoride, sulfuric acid and aluminum chloride.

8. A process in accordance with claim 1, wherein at least one amylene contained in said hydroisomerizate is 2-methylbutene-2.

9. A process in accordance with claim 1, wherein said at least one amylene contained in said hydroisomerizate is 2-methylbutene-1.

10. A process for converting gasoline components to motor fuel components of lower volatility and higher octane rating which comprises the steps of:

(1) subjecting at least one gasoline feedstock comprising hydrocarbons containing 4–12 carbon atoms per molecule to fractional distillation under such conditions as to obtain an overhead fraction comprising primarily hydrocarbons containing 4–5 carbon atoms per molecule and a bottoms fraction comprising primarily hydrocarbons containing at least 6 carbon atoms per molecule;

(2) contacting the overhead fraction obtained in step (1) with added hydrogen gas and an effective hydroisomerization catalyst under such conditions as to substantially convert n-pentene-1 being present in said overhead fraction to n-pentene-2 and to substantially hydrogenate 1,3-pentadiene present in said overhead fraction to n-pentane;

(3) contacting the hydroisomerate obtained in step (2) with added methanol and an effective etherification catalyst in an etherification reactor so as to substantially convert the added methanol and at least one amylene selected from the group consisting of 2-methylbutene-2 and 2-methylbutene-1 contained in said hydroisomerate to tertiary-amyl methyl ether;

(4) separating the formed tertiary-amyl methyl ether from hydrocarbons containing 4–5 carbon atoms per molecule being present in the etherification product obtained in step (3);

(5) subjecting the hydrocarbons containing 4–5 carbon atoms per molecule obtained in step (4) to fractional distillation under such conditions as to obtain an overhead fraction containing primarily butenes and a bottom fraction containing primarily C5 paraffins and C5 olefins;

(6) subjecting the debutanized bottoms fraction obtained in step (5 ) to fractional distillation under such conditions as to obtain an overhead fraction containing primarily at least one isopentane and a bottoms fraction containing primarily internal amylenes and n-pentane; and (7) introducing the overhead fraction from step (5), the bottoms fraction from step (6), and additional isobutane from an external source into an alkylation reactor, and contacting the thus-obtained hydrocarbon mixture with an effective alkylation catalyst under such conditions as to obtain an alkylation reaction product containing primarily paraffins containing at least 8 carbon atoms per molecule;

(8) contacting the overhead fraction containing primarily at least one isopentene from step (6) with an effective hydrogenation catalyst under such conditions as to convert a major portion of said at least one isopentene to at least one isoamylene; and (9) introducing the dehydrogenation product obtained in step (8), together with the hydroisomerate from step (2) and added methanol into the etherification reactor of step (3) where said at least one isoamylene contained in said dehydrogenation product, said at least one amylene contained in said hydroisomerate obtained in step (2) and added methanol are substantially converted to t-amyl methyl ether.

11. A process in accordance with claim 8, comprising the additional step of mixing the bottoms fraction obtained in step (1), tertiary-amyl methyl ether obtained in step (4) and the alkylate product obtained in step (7), so as to produce a motor fuel.

12. A process in accordance with claim 8, wherein the hydroisomerization step (2) is carried out at a temperature of about 100°-300° F., a pressure of about 150-300 psig, and a molar hydrogen:hydrocarbon ratio of about 1:1000 to about 1:10.

13. A process in accordance with claim 10, wherein the catalyst used in said hydroisomerization step contains about 0.01-2.0 weight percent palladium and alumina as a carrier.

14. A process in accordance with claim 8, wherein the etherification step (3) is carried out at a temperature of about 30°-120° C., a pressure of bout 30-300 psig and a molar ratio of methanol to said at least one amylene of about 0.8:1 to about 1:1.

15. A process in accordance with claim 12, wherein the catalyst employed in said etherification step is a sulfonated styrene-divinylbenzene copolymer ion-exchange resin containing about 0.5-20 weight-% divinylbenzene repeat units.

16. A process in accordance with claim 8, wherein alkylation step (7) is carried out at a temperature of about 90°-110° F. and a pressure of about 90-120 psig, in the presence of a catalyst selected from the group consisting of hydrogen fluoride, sulfuric acid and aluminum chloride.

17. A process in accordance with claim 8, wherein dehydrogenation step (8) is carried out at a temperature of about 500°-650° C., a pressure of about 0-200 psig, and a molar steam:hydrocarbon ratio of about 0.5:1 to about 30:1.

18. A process in accordance with claim 15, wherein the catalyst employed in said dehydrogenation step comprises about 0.05-5 weight percent platinum, about 0.1-5 weight percent tin, about 5-25 weight percent calcium aluminate, and zinc aluminate as the remainder.

19. A process in accordance with claim 8, wherein said at least one amylene contained in said hydroisomerizate is 2-methylbutene-2.

20. A process in accordance with claim 8, wherein said at least one amylene contained in said hydroisomerizate is 2-methylbutene-1.

* * * * *

UNITED STATES PATENT AND TRADEMARK OFFICE

CERTIFICATE OF CORRECTION

PATENT NO. : 5,254,790

DATED : October 19, 1993

INVENTOR(S) : Gregory D. Thomas and Vernon A. Cawi

It is certified that error appears in the above-identified patent and that said Letters Patent is hereby corrected as shown below:

Claim 10, Column 10, line 62, delete "isopentene" and substitute --- isopentane --- therefor.

Claim 10, Column 10, line 63, delete "hydrogenation" and substitute --- dehydrogenation --- therefor.

Claim 10, Column 10, line 65, delete "isopentene" and substitute --- isopentane --- therefor.

Signed and Sealed this

Twenty-ninth Day of March, 1994

*Attest:*

Bruce Lehman

BRUCE LEHMAN

*Attesting Officer*

*Commissioner of Patents and Trademarks*